US006755192B2

(12) United States Patent
Potkin

(10) Patent No.: US 6,755,192 B2
(45) Date of Patent: Jun. 29, 2004

(54) APPARATUS FOR PREVENTING OR MINIMIZING DECOMPRESSION ILLNESS IN A SCUBA DIVER

(76) Inventor: Ralph T. Potkin, 1125 S. Beverly Dr. Apt. 406, Los Angeles, CA (US) 90035

( * ) Notice: Subject to any disclaimer, the term of this patent is extended or adjusted under 35 U.S.C. 154(b) by 0 days.

(21) Appl. No.: 10/193,677

(22) Filed: Jul. 12, 2002

(65) Prior Publication Data

US 2003/0101994 A1 Jun. 5, 2003

Related U.S. Application Data

(60) Provisional application No. 60/335,794, filed on Dec. 5, 2001.

(51) Int. Cl.[7] ..... B63C 11/02

(52) U.S. Cl. ..... 128/201.27; 128/201.28; 128/205.11; 405/185; 405/188

(58) Field of Search ..... 428/201.27, 201.28, 428/205.11, 205.22, 204.26, 201.11; 405/186, 187, 188, 189, 185

(56) References Cited

U.S. PATENT DOCUMENTS

| | | | | |
|---|---|---|---|---|
| 813,431 A | * | 2/1906 | Iwanami et al. | 128/201.27 |
| 3,040,762 A | | 6/1962 | Spiotta | |
| 3,832,746 A | | 9/1974 | Korsgaard | |
| 3,920,011 A | | 11/1975 | Losee | |
| 4,166,462 A | | 9/1979 | Ellis | |
| 4,919,631 A | * | 4/1990 | Stafford | 441/40 |
| 4,986,267 A | * | 1/1991 | Doss | 128/201.27 |
| 5,328,298 A | * | 7/1994 | Maffatone | 405/185 |
| 5,411,018 A | | 5/1995 | Rinehart | |
| 5,560,738 A | | 10/1996 | Noel | |
| 5,678,542 A | * | 10/1997 | Maffatone | 128/205.24 |
| 5,839,931 A | | 11/1998 | Shieh | |
| 5,906,200 A | | 5/1999 | Kaburaki | |
| 5,924,521 A | | 7/1999 | Crockett | |
| 6,227,766 B1 | * | 5/2001 | Cook | 405/186 |
| 6,293,733 B1 | * | 9/2001 | Tezuka | 405/185 |

FOREIGN PATENT DOCUMENTS

FR 2627148 A1 * 8/1989 ..... B63C/11/26

* cited by examiner

*Primary Examiner*—Henry Bennett
*Assistant Examiner*—Amanda Flynn
(74) *Attorney, Agent, or Firm*—Rothwell, Figg, Ernst & Manbeck, P.C.

(57) ABSTRACT

An apparatus for preventing or minimizing decompression illness in a scuba diver, consisting of a first safety bar, at least one first cable attached to the first safety bar, and an oxygen delivery system. The first cable supports the first safety bar at a predetermined depth. The oxygen delivery system consists of an oxygen tank, an oxygen delivery line, a manifold attached to the oxygen delivery line, and a plurality of regulators attached to the manifold. When the oxygen delivery system will be used by only one scuba diver, the oxygen delivery line can be connected directly to a single regulator without the manifold. The first cable and oxygen tank are attached to a float, which is either secured to a boat or platform via a tether line or anchored to the sea floor. In an alternative embodiment, the first cable is attached directly to a boat or platform, and an oxygen supply is provided on the boat or platform. In another alternative embodiment, the apparatus further includes a second safety bar connected to the first safety bar by at least one second cable, which supports the second safety bar at a predetermined depth below the depth of the first safety bar.

13 Claims, 4 Drawing Sheets

APPARATUS FOR PREVENTING OR MINIMIZING DECOMPRESSION ILLNESS IN A SCUBA DIVER

RELATED APPLICATION:

The present application claims priority from U.S. Provisional patent application Ser. No. 60/335,794, filed Dec. 5, 2001. The disclosure of the above-referenced provisional patent application is incorporated herein by reference in its entirety.

BACKGROUND OF THE INVENTION

1. Field of the Invention

The present invention relates generally to diving safety devices, and in particular, to an apparatus for preventing or minimizing decompression illness in a scuba diver.

2. Background and Related Art

Scuba divers are at risk for developing medical problems referred to as decompression illness (commonly known as the "Bends"), which is due to the formation of nitrogen bubbles in the tissues of the body. When these nitrogen bubbles form in the nervous system, problems such as numbness, weakness, paralysis, stroke and even death can result. Various theories exist to explain nitrogen bubble formation and elimination and these theories form the basis of diving decompression tables and algorithms used in dive computers. Several factors such as dive depth and duration are associated with increased nitrogen loading to the body and thus increased risk of decompression illness. Bubble formation can be minimized and bubble elimination can be optimized by slowing the ascent rate during decompression to allow nitrogen gas to be eliminated without forming clinically important tissue bubbles. Recommended ascent rates range from 30 to 60 feet per minute or even slower. Another method of minimizing nitrogen bubble formation and optimizing nitrogen bubble elimination includes the step of stopping at various depths prior to reaching the surface. Yet another effective strategy includes breathing 100% oxygen during a decompression stop, which minimizes nitrogen absorption, enhances nitrogen elimination and shortens the required decompression time.

Several devices for simplifying the ascent process exist in the art. One such device is disclosed in Shieh, U.S. Pat. No. 5,839,931. Shieh discloses a safety stop anchor including a buoy distantly connected to a scuba diver via a fixing rope. Before the scuba diver returns to the surface, the buoy helps the scuba diver to easily and relaxedly stay at the required safety decompression stop or stops to avoid nitrogen bubble formation. A buoyancy control valve is provided on the buoy so that heavy loads can be provided with neutral buoyancy and can therefore be more easily carried underwater and to the water surface. Thus, the apparatus of Shieh remains continuously connected to the scuba diver. Additionally, the apparatus does not provide for an alternative oxygen supply to further reduce nitrogen absorption.

Another prior art device is disclosed in Maffatone, U.S. Pat. No. 5,328,298. Maffatone discloses an ascent/decompression device for use in diving with an inflatable lift bag, which includes a pack for securing the ascent/decompression device on a diving harness worn by a scuba diver; a reel mounted for rotation to the pack and having a decompression line wound thereabout, the decompression line being connected to the lift bag; and a cable for securing the apparatus to a ship wreck on the sea floor. The apparatus utilizes an elaborate system to allow the scuba diver to follow the cable to the surface and then recover the cable once the scuba diver reaches the surface. As with the Shieh device, the Maffatone apparatus remains continuously connected to the scuba diver and does not provide for an alternative oxygen supply.

There continues to exist a need for an apparatus for preventing or minimizing decompression illness in a scuba diver that overcomes the shortcomings of the prior art.

SUMMARY OF THE INVENTION

The present invention is characterized in an apparatus for preventing or minimizing decompression illness in a scuba diver, consisting of a first safety bar, at least one first cable attached to the first safety bar, and an oxygen delivery system. The first cable supports the first safety bar at a predetermined depth. The oxygen delivery system consists of an oxygen tank, an oxygen delivery line, a manifold attached to the oxygen delivery line, and a plurality of regulators attached to the manifold. When the oxygen delivery system will be used by only one scuba diver, the oxygen delivery line can be connected directly to a single regulator without the manifold. The first cable and oxygen tank are attached to a float, which is either secured to a boat or platform via a tether line or anchored to the sea floor. In an alternative embodiment, the first cable is attached directly to a boat or platform, and an oxygen supply is provided on the boat or platform. In another alternative embodiment, the apparatus further includes a second safety bar connected to the first safety bar by at least one second cable, which supports the second safety bar at a predetermined depth below the depth of the first safety bar. In yet another alternative embodiment, the apparatus further includes a plurality of safety bars connected in series to the second safety bar by a plurality of cables, which support the plurality of safety bars at predetermined depths below the depth of the second safety bar.

DETAILED DESCRIPTION OF THE PREFERRED EMBODIMENTS

An exemplary embodiment of an apparatus for preventing or minimizing decompression illness in a scuba diver is described herein.

Figure 1:
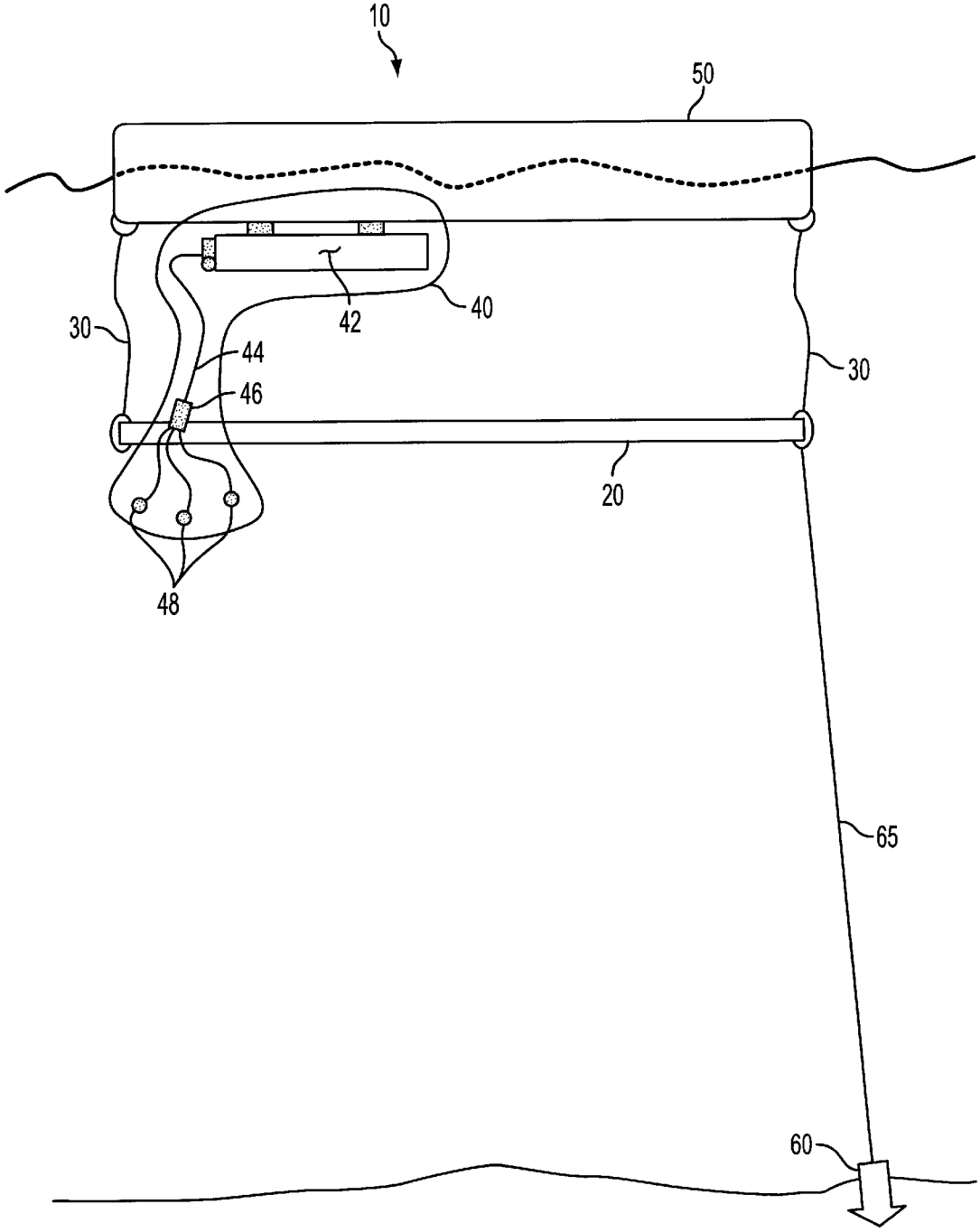
FIG. 1 is a perspective view of the apparatus of the present invention.

Referring now in detail to the drawings wherein like parts are designated by like reference numerals throughout, there is in FIG. 1 the apparatus 10, referred to by its trademark SAFE-D-STOP, that includes a first safety bar 20, at least one first cable 30 attached to first safety bar 20, and an oxygen delivery system 40.

Describing the SAFE-D-STOP 10 in more detail, first safety bar 20 is constructed from type 304 stainless steel ½ inch diameter hollow pipe, and can be made of various lengths to accommodate various numbers of divers. Pipe lengths of 2, 4, 6, and 8 feet are exemplary. As an alternative to hollow pipe, a platform or stand may be utilized.

At least one first cable 30 is connected to first safety bar 20. As depicted in FIG. 1, two first cables 30 are attached on each end of float 50 and first safety bar 20. Alternatively, different numbers of first cables 30 may be selected, depending on balance, weight, strength, stability, and other considerations. Preferably, first cable 30 is constructed from ¼ inch diameter polypropylene line. Alternatively, stainless steel chain line or any other suitable corrosion-resistant material may be selected. Color coding of first cable 30 and/or first safety bar 20 can be utilized to readily identify the depth of first safety bar 20. Numbered placards could also be utilized to accomplish a similar result. Typically, the length of first cable 30 is chosen so that first safety bar 20 will be maintained at a depth of between 10 and 15 feet when SAFE-D-STOP 10 is in operation. Of course, different lengths of first cable 30 may be selected, depending on the circumstances of a specific dive profile.

Oxygen delivery system 40 is shown attached to float 50. Oxygen delivery system 40 provides oxygen to a scuba diver or divers in order to facilitate nitrogen bubble elimination and thus further reduce the risk of decompression illness. By oxygen it is meant enriched air with an oxygen concentration anywhere from normal atmospheric air (approximately 21%) to 100%. A higher oxygen concentration, for example substantially 100%, is preferred, as the higher oxygen concentration facilitates faster nitrogen bubble elimination. Float 50 can be any device with enough buoyancy to support oxygen delivery system 40 and SAFE-D-STOP 10, to include a cylindrical float (as shown) or a plurality of individual buoys. A hollow cylindrical float is preferred, as one end of it can be opened and SAFE-D-STOP 10 can be stored therein when the apparatus is not in use, thus providing for compact and portable storage.

Also as shown in FIG. 1, oxygen delivery system 40 includes oxygen tank 42 attached to float 50, oxygen delivery line 44 attached to oxygen tank 42, manifold 46 attached to oxygen delivery line 44, and regulators 48 attached to manifold 46. When only one scuba diver will use SAFE-D-STOP 10, manifold 46 may be eliminated and a single regulator 48 can be attached directly to oxygen delivery line 44 (not illustrated).

Oxygen tank 42 is any suitable oxygen storage and delivery device. Oxygen delivery line 44 is preferably constructed from stainless steel, and is of a suitable length so as to maintain manifold 46 and regulators 48 at the level of first safety bar 20. This allows the divers to switch from their own personal regulators to regulators 48 when they reach first safety bar 20 and begin breathing oxygen from oxygen tank 42.

Figure 4:
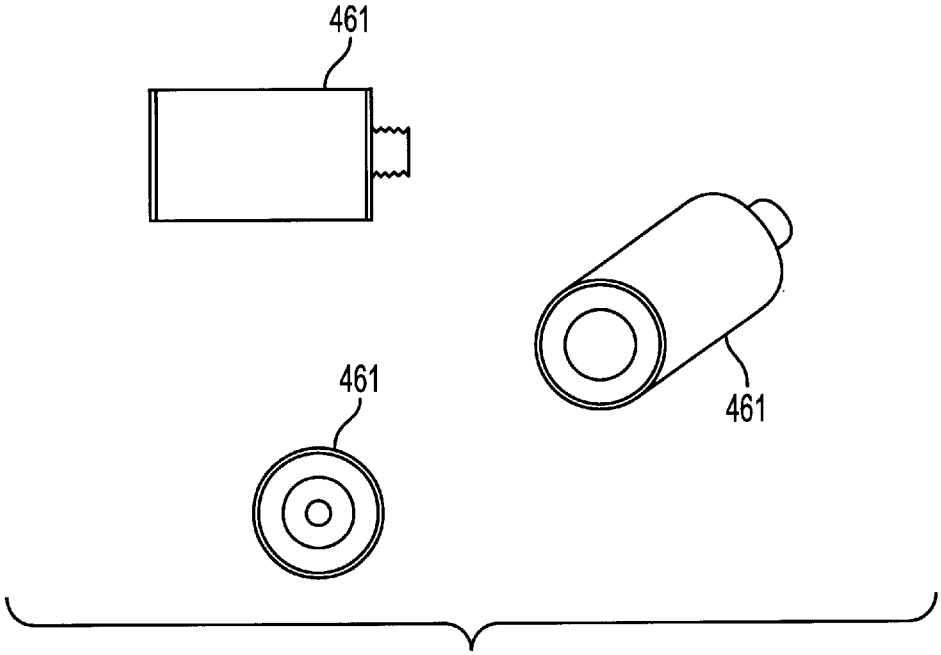
FIG. 4 is composite drawing showing multiple views of the first stage connector.
Figure 5:
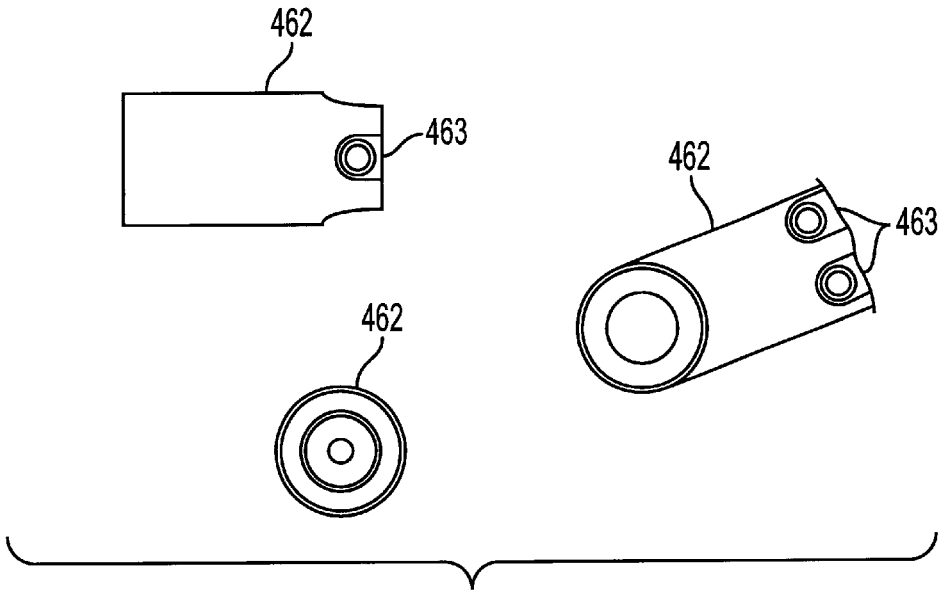
FIG. 5 is a composite drawing showing multiple views of the second stage connector.

Manifold 46 was specially designed and manufactured for the purposes of this apparatus, and includes first stage connector 461, shown in FIG. 4, and second stage connector 462, shown in FIG. 5. First stage connector 461 attaches to oxygen delivery line 44. Second stage connector 462 attaches to first stage connector 461, and includes several openings 463 designed to receive manifolds 48. As shown, second stage connector 462 includes openings for multiple manifolds 48, arranged in an octopus or hookah like setup, in order to accommodate multiple scuba divers. Second stage connector 462 can be constructed so as to include any number of openings 463, to accommodate any number of divers. Regulators 48 are of standard design, which will be appreciated by those skilled in the art.

As discussed, FIG. 1 depicts SAFE-D-STOP 10 attached to float 50. In order to prevent significant drift of SAFE-D-STOP 10 due to wind or current, anchor 60 is provided. Anchor 60 is attached to anchor line 65, which in turn is attached to first safety bar 20. Alternatively, anchor line 65 could be attached directly to float 50.

Figure 2:
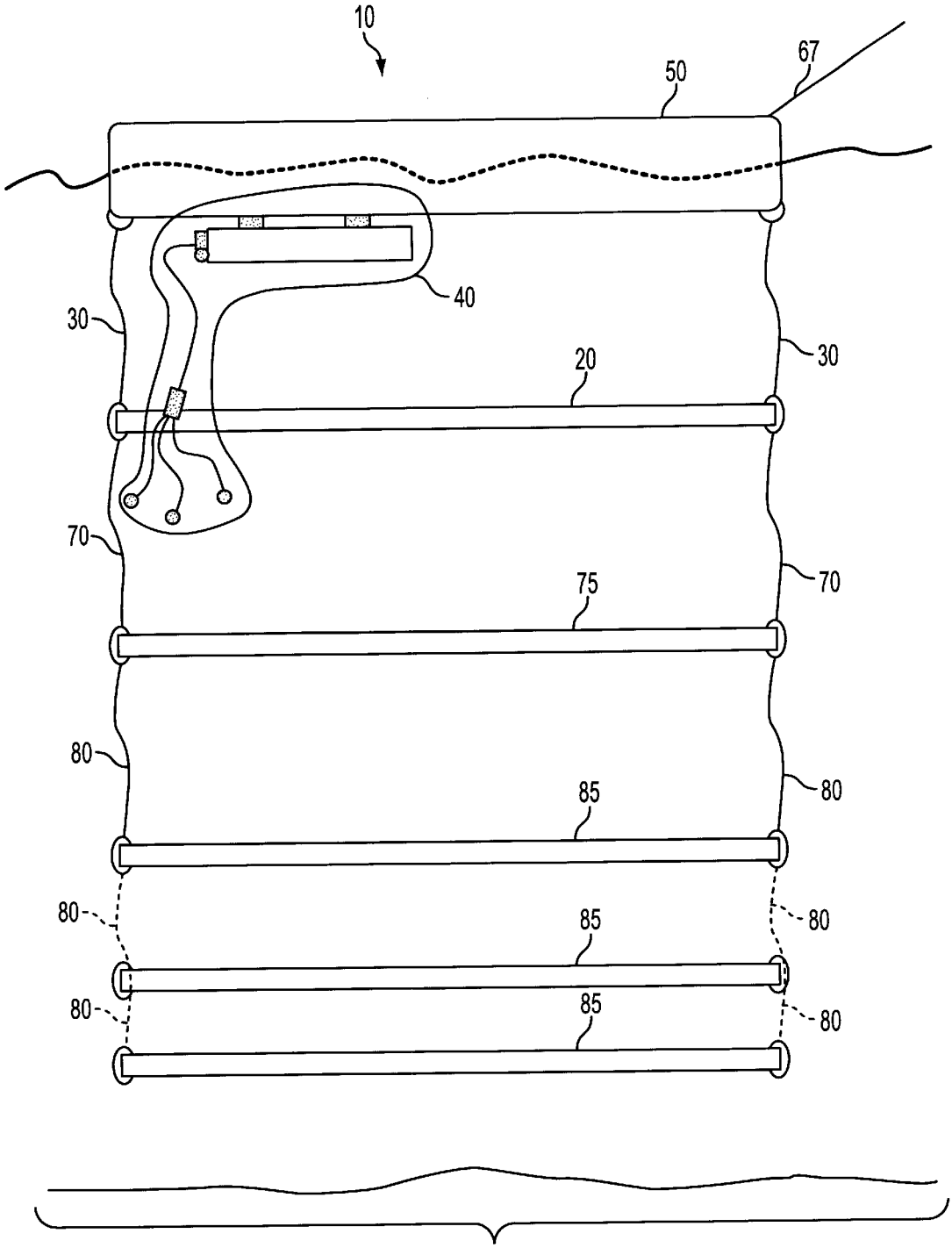
FIG. 2 is a perspective view of the apparatus of the present invention in several alternative embodiments.

FIG. 2 depicts several alternative embodiments of the apparatus of the present invention. In a first alternative embodiment, one end of tether line 67 is attached to float 50 on SAFE-D-STOP 10. The other end of tether line 67 is attached to a boat in order to prevent SAFE-D-STOP 10 from drifting away due to wind or current. Alternatively, the other end of tether line 67 can be attached to a platform, such as a diving platform.

In another alternative embodiment, at least one second cable 70 is attached to first safety bar 20 on one end and second safety bar 75 on the other end. Thus, at least one second cable 70 supports second safety bar 75 at a predetermined depth below first safety bar 20. Second safety bar 75 and/or at least one second cable 70 can be color coded or numerically marked for easy identification of this deeper decompression stop. In yet another alternative embodiment, a plurality of cables 80 attach a plurality of safety bars 85 in series at predetermined depths below second safety bar 75. Each plurality of safety bars 85 or plurality of cables 80 can be individually color-coded or numerically marked, so as to indicate their depth. This arrangement thus allows for several decompression stops, beginning at the deepest safety bar and ending at first safety bar 20. In a preferred embodiment, three safety bars would be employed, and the lengths of cables 30, 70, and 80 would be selected so as to maintain safety bars 20, 75, and 85 at depths of 15, 30, and 40 feet, respectively.

Figure 3:
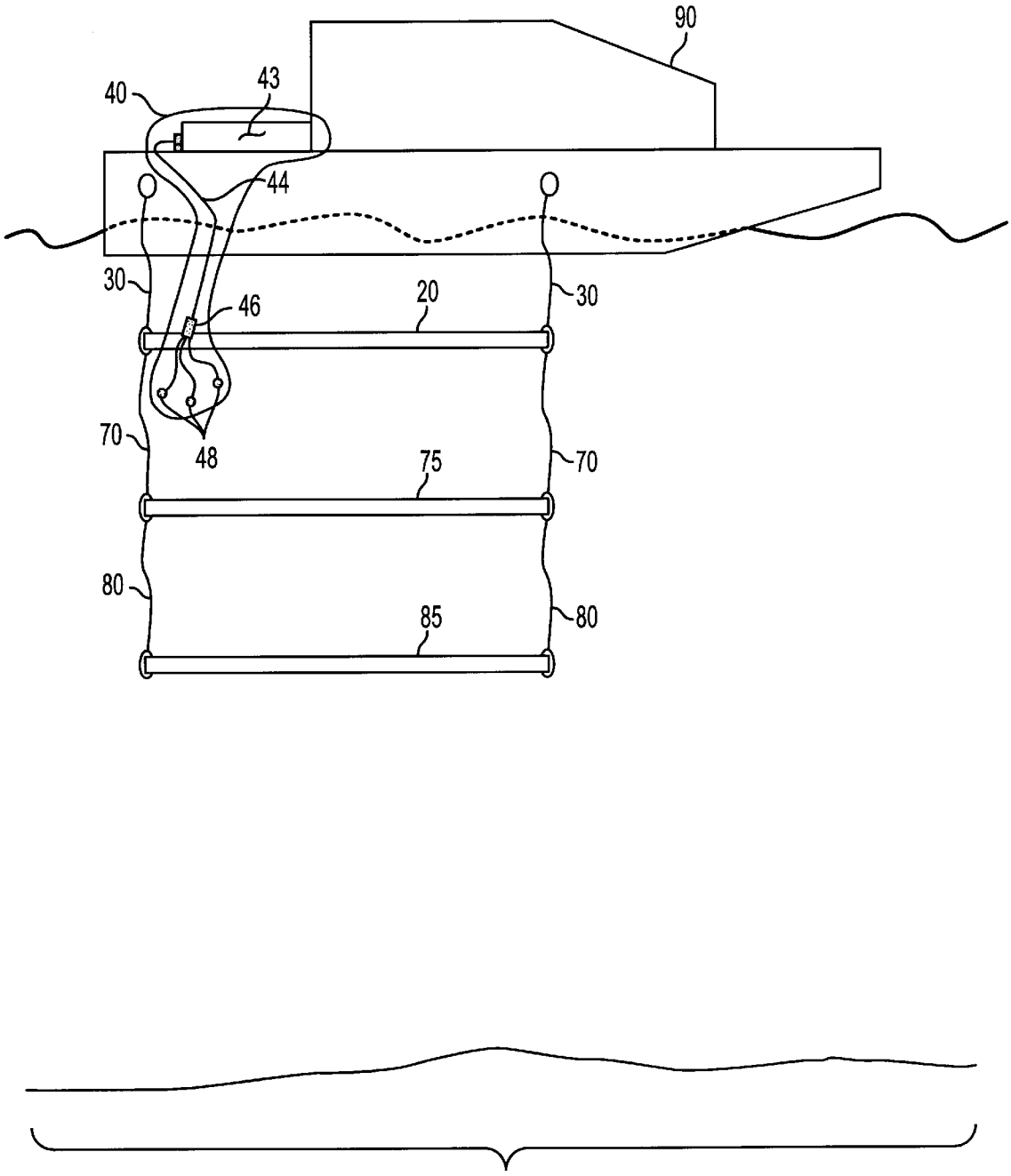
FIG. 3 is a perspective view of the apparatus of the present invention in yet another alternative embodiment.

As shown in another alternative embodiment in FIG. 3, at least one first cable 30 is attached to boat 90, and oxygen delivery system 40 includes an oxygen supply 43 on boat 90. This eliminates the need for float 50 and anchor 60/anchor line 65 or tether line 67, as described above and shown in FIGS. 1 and 2. Oxygen delivery line 44 would be of an appropriate length so as to allow manifold 46 and regulators 48 to supply oxygen to scuba divers at a depth approximately corresponding to first safety bar 20, the advantage of which is discussed above. At least one first cable 30 could be attached in any suitable location on boat 90. Alternatively, at least one first cable 30 can be attached to a platform, such as a diving platform (not illustrated). The oxygen supply 43 of oxygen delivery system 40 would be located on the platform.

The appropriate ends of the cables described above are preferably connected to their respective safety bars, floats, boats, and platforms with type 304 stainless steel clips. Other appropriate connection methods may be employed, as will be appreciated by one skilled in the art.

In an example of operation in a preferred embodiment, SAFE-D-STOP 10 is assembled on a dive boat and dropped into the water. For the purposes of this example, two scuba divers will be conducting a dive, and oxygen delivery system 40 includes oxygen tank 42 attached to float 50, oxygen delivery line 44, manifold 46 and two regulators 48. Tether line 67 is attached to the dive boat on one end and SAFE-D-STOP 10 on the other end. The scuba divers conduct their dive, and when they are ready to surface they ascend to the first decompression stop at the deepest safety bar 85 at the 40-foot level. This safety bar is color coded or numerically marked so as to indicate its depth. After waiting a suitable time at this decompression stop, the scuba divers ascend to the next decompression stop at second safety bar 75 at the 30-foot level. This safety bar is also color coded or numerically marked to indicate its depth. After waiting another period of time at this decompression stop, the scuba divers ascend to the final decompression stop at first safety bar 20 at the 15-foot level, also color coded or numerically marked. At this point the scuba divers stop using their own regulators, which have been supplying air, and commence using regulators 48, so as to receive oxygen from oxygen delivery system 40. After waiting a predetermined time, the scuba divers ascend to the surface and complete their dive.

As can be seen from the preceding description, the apparatus of the present invention incorporates current decompression theory, emphasizing the importance of staged decompression and the use of enriched air and/or pure oxygen for the breathing gas at the decompression stop to minimize nitrogen loading of tissue bubble formation and thereby preventing or minimizing decompression illness. The use of SAFE-D-STOP will thus improve diver safety. The apparatus is simple to use, sturdy, and inexpensive, and will become a standard component of scuba diving equipment for the individual scuba diver as well as dive groups and dive operators worldwide.

While the invention has been described in connection with what are presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

What is claimed is:

1. An apparatus for preventing or minimizing decompression illness in a scuba diver who has been diving in a body of water, said apparatus comprising:

a first safety bar;

at least one first cable attached to said first safety bar, said at least one first cable supporting said first safety bar at a predetermined depth; and an oxygen delivery system for supplying oxygen-enriched air to the scuba diver, wherein said oxygen delivery system is separate from said scuba diver's personal air supply.

2. The apparatus of claim 1, wherein said at least one first cable is attached to a float.

3. The apparatus of claim 2, wherein said oxygen delivery system comprises:

an oxygen tank attached to said float;

an oxygen delivery line attached to said oxygen tank; and a regulator attached to said oxygen delivery line, said regulator allowing a scuba diver to consume oxygen from said oxygen delivery system.

4. The apparatus of claim 2, wherein said oxygen delivery system comprises:

an oxygen tank attached to said float;

an oxygen delivery line attached to said oxygen tank;

a manifold attached to said oxygen delivery line; and at least one regulator attached to said manifold, said at least one regulator allowing at least one scuba diver to consume oxygen from said oxygen delivery system.

5. The apparatus of claim 2, further comprising an anchor affixed to said apparatus by an anchor line.

6. The apparatus of claim 2, further comprising a tether line, wherein one end of said tether line is attached to said apparatus and the other end of said tether line is attached to a boat that is floating on the surface of said body of water.

7. The apparatus of claim 2, further comprising a tether line, wherein one end of said tether line is attached to said apparatus and the other end of said tether line is attached to a platform.

8. The apparatus of claim 1, wherein said at least one first cable is attached to a boat that is floating on the surface of said body of water.

9. The apparatus of claim 8, wherein said oxygen delivery system comprises:

an oxygen supply on said boat;

an oxygen delivery line attached to said oxygen supply; and a regulator attached to said oxygen delivery line, said regulator allowing a scuba diver to consume oxygen from said oxygen supply.

10. The apparatus of claim 8, wherein said oxygen delivery system comprises:

an oxygen supply on said boat;

an oxygen delivery line attached to said oxygen supply;

a manifold attached to said oxygen delivery line; and at least one regulator attached to said manifold, said at least one regulator allowing at least one scuba diver to consume oxygen from said oxygen supply.

11. The apparatus of claim 1, further comprising:

a second safety bar; and at least one second cable;

wherein one end of said at least one second cable is attached to said first safety bar and the other end of said at least one second cable is attached to said second safety bar, and wherein said at least one second cable supports said second safety bar at a predetermined depth below the depth of said first safety bar.

12. The apparatus of claim 11, further comprising:

a plurality of safety bars; and a plurality of cables attaching said plurality of safety bars to said second safety bar in series, said plurality of cables supporting said plurality of safety bars at predetermined depths below the depth of said second safety bar.

13. The apparatus of claim 1, wherein said at least one first cable is attached to a platform that is floating on the surface of said body of water.

* * * * *